United States Patent [19]

Watts, Jr.

[11] 4,244,156

[45] Jan. 13, 1981

[54] POLE AND PILING PROTECTOR

[76] Inventor: Ridley Watts, Jr., 34000 Cedar Rd., Gates Mills, Ohio 44040

[21] Appl. No.: 966,089

[22] Filed: Dec. 4, 1978

Related U.S. Application Data

[63] Continuation-in-part of Ser. No. 874,875, Feb. 3, 1978, Pat. No. 4,161,090

[51] Int. Cl.[3] ..... E04G 21/00

[52] U.S. Cl. ..... 52/746; 47/2; 47/23; 52/170; 52/309.5; 52/516; 52/728

[58] Field of Search ..... 52/170, 309.5, 309.9, 52/516, 517, 515, 743, 744; 47/2, 23; 405/216

[56] References Cited

U.S. PATENT DOCUMENTS

| | | | |
|---|---|---|---|
| 939,749 | 11/1909 | Sagendorph | 52/727 |
| 1,178,673 | 4/1916 | Plank | 52/630 |
| 1,244,119 | 10/1917 | Malnix | 52/728 |
| 1,665,995 | 4/1928 | Wiley | 52/170 |
| 2,791,463 | 5/1957 | Levitt | 52/630 |
| 3,403,520 | 10/1968 | Goodman | 52/170 |
| 3,419,134 | 12/1968 | Fitts | 206/47 |
| 3,611,736 | 10/1971 | Goodman | 52/515 |
| 3,736,759 | 6/1973 | Blöse | 405/216 |
| 3,771,748 | 11/1973 | Jones | 244/123 |
| 4,036,673 | 7/1977 | Murphy | 156/71 |

FOREIGN PATENT DOCUMENTS

| | | | |
|---|---|---|---|
| 32810 | 1/1908 | Austria | 52/728 |
| 79154 | of 1895 | Fed. Rep. of Germany | 52/727 |

*Primary Examiner*—James A. Leppink
*Assistant Examiner*—H. E. Raduazo
*Attorney, Agent, or Firm*—Watts, Hoffmann, Fisher & Heinke Co.

[57] ABSTRACT

A tubular plastic shell, with an overlapped longitudinal seam and longitudinally extending interior pockets that form exterior ribs, encircles a wooden pole or piling in an area to be protected. A foamed adhesive between the shell and pole fills and seals the surface of the pole beneath the shell, adheres the shell, and provides a supporting cushion for the shell that inhibits cracking or puncturing from impact. Longitudinally spaced ends of the shell beyond the pockets tightly encircle the pole to prevent escape of the adhesive as it forms during application. Ribs at the overlapped seam nest into pockets to retain the shell tightly about the pole during expansion of the adhesive. Where impact or abrasion are not anticipated, the shell can be used as a carrier and mold for forming an adherent foamed sealant layer or covering about a pole and then be removed.

2 Claims, 8 Drawing Figures

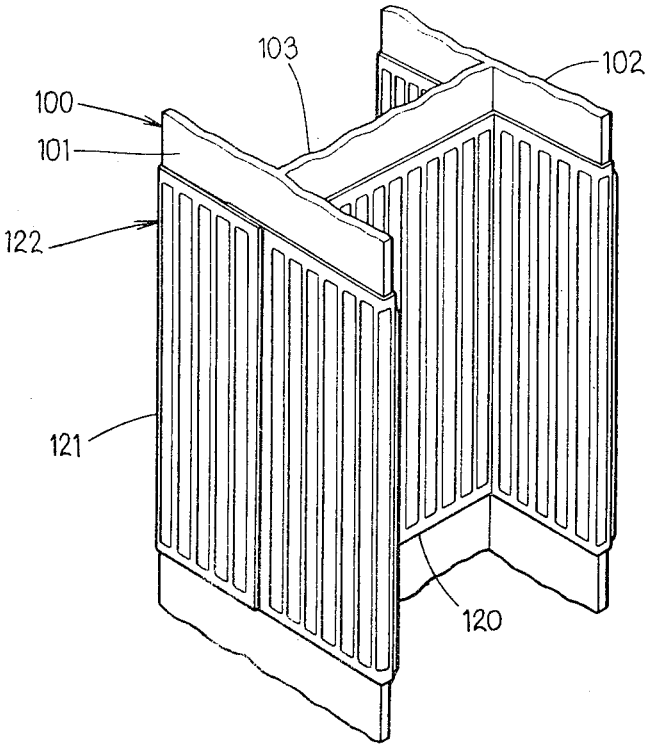
FIG. 9
FIG. 10
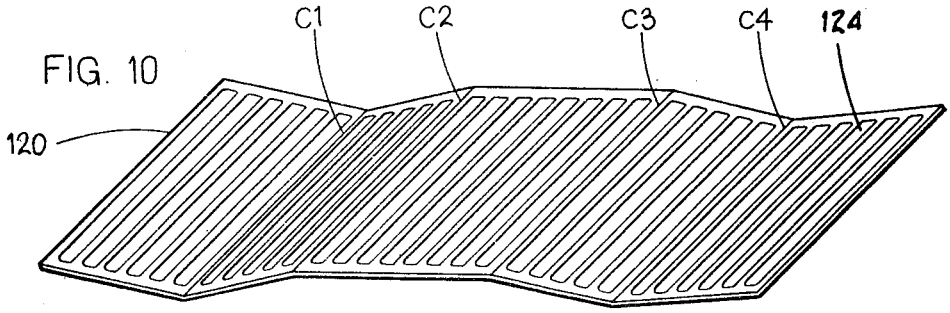
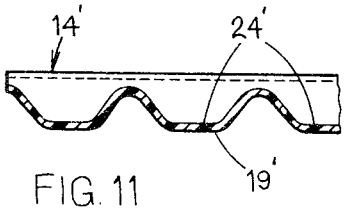
FIG. 11

POLE AND PILING PROTECTOR

CROSS REFERENCE TO RELATED APPLICATION

This application is a continuation-in-part of copending application Ser. No. 874,875 filed Feb. 3, 1978, entitled Post Assembly and Method now U.S. Pat. No. 4,161,090.

BACKGROUND OF THE INVENTION

1. Field of the Invention

This invention relates to poles or pilings and encircling protective jackets or shells.

2. Prior Art

Deterioration of wooden poles or posts and pilings exposed to the weather and outside environment is a common problem. Deterioration at the ends of wooden posts and pilings due to exposure to the weather, and a solution to the problem is described in the aforementioned copending application. An additional problem experienced with pilings used along shore lines is deterioration at the high tide splash line. Also, wooden poles embedded in the ground tend to rapidly deteriorate at the ground line. In the past, deterioration of piling or pole portions intermediate the ends was primarily inhibited by the use of wood preservatives.

Deterioration of pilings and poles at the splash or ground line is primarily caused by insects, worms, and other organisms harbored by the wood. Where the wood is moist and there is sufficient oxygen, these insects, worms and other organisms become active within the wood and bore, chew or otherwise destroy the wood, directly weakening the piling or pole and facilitating subsequent rot. Deterioration of pilings at the splash line has become more prevalent as environmental efforts have resulted in cleaner water, which contains higher concentrations of oxygen that support aquatic life. Poles embedded in the ground deteriorate in a zone that extends several inches above and below the ground level. This is apparently due to the availability in that zone of both oxygen and moisture that creates an environment most attractive to organisms. Wood preservatives, bags or caps over the ends of poles, and sheet-like wrappings have not provided adequate protection to these intermediate areas, and in particular have not protected adequately against abrasion or been sufficiently resistant to puncture, or effectively isolated the area from moisture and oxygen to prevent this type of deterioration.

SUMMARY OF THE INVENTION

In accordance with the present invention, a portion of a pole or piling intermediate its ends is sealed from oxygen and protected from abrasion and impact. By sealing the surface of a pole or piling from oxygen and moisture along a portion of its length that is located in use adjacent the splash line or ground line, insects and other organisms cannot gain entry and those with which the wood may already be infested die.

The pole or piling is sealed and protected intermediate the ends by the use of a tubular shell or jacket that is applied in strip form about the pole or piling at the desired location, and by expanding a foamable resin adhesive between the shell and pole in a way that assures that the resin covers the desired surface and fills all surface crevices, to form an air tight seal about a band of substantial length, located at the ground line, splash line or other desired zone.

In the preferred embodiment, the shell or jacket is of a tubular configuration with an overlapped longitudinal seam. A substantially cylindrical inside surface, congruent with the pole or piling to be protected, and is interrupted by spaced pockets that extend outwardly of the cylindrical configuration. Where the pole or piling is non-cylindrical, the configuration of the tubular shell will also be non-cylindrical to closely encircle the pole or piling. The pockets are substantially deeper than the thickness of the shell or jacket and form external projections. They are located about and along the shell, and terminate inwardly of longitudinally spaced ends. One or more of the projections is nested within one or more pockets at the overlapped longitudinal seam to retain the jacket tightly about the post or piling during expansion of the foamable adhesive material, which is applied to the inside cylindrical surface and in the pockets of the shell and foamed in place between the post or piling and the shell. Expansion of the foam forces the adhesive under pressure into all crevices, completely filling the space between the shell and pole surface. The axially spaced ends of the shell that extend beyond the ribs or pockets tightly encircle the pole or piling to inhibit escape of the adhesive as it foams and expands during application. The cured, foamed, adhesive provides a supporting cushion for the shell that inhibits cracking or puncturing from impact during use, and the shell itself protects the pole or piling and the adhesive sealant against abrasion.

Advantageously, a strip of shell-forming material is cut to a length that allows overlap and nesting of one or more pockets and external projections. The foamable adhesive resin material is preferably a two-component mixture that is mixed and then spread on the inside surface of the strip, filling the pockets, which provide receptacles for the adhesive material. This assures a uniform distribution of the adhesive material around the circumference of the pole and promotes the formation of a uniform and cushion beneath the shell. The strip is then wrapped into a tubular shape about the pole, tightly encircling the pole and is held against expansion by the nested pockets and projections. The adhesive resin foams in place, expands into crevices of the pole, completely fills the space between the pole and jacket, and adheres the jacket or shell firmly to the pole or piling.

The above and other features and advantages of the invention will become better understood from the detailed description that follows, when considered in connection with the accompanying drawings.

DETAILED DESCRIPTION OF PREFERRED EMBODIMENTS

Figure 1:
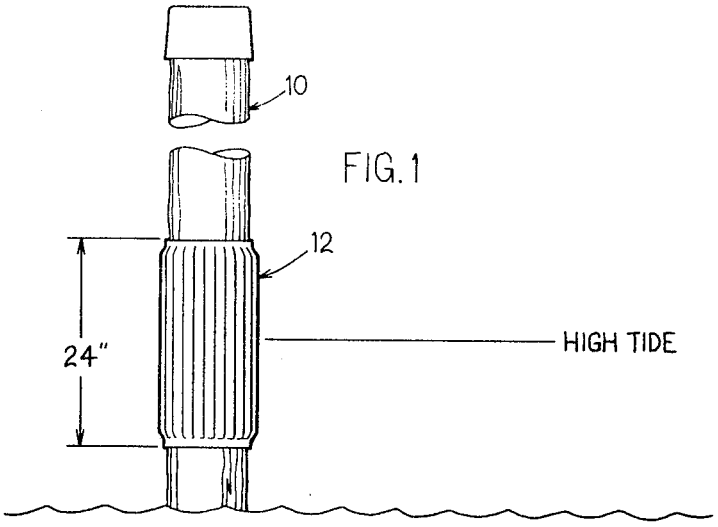
FIG. 1 is an elevational view of a piling and protective shell embodying the present invention.

A piling 10, in the form of a cylindrical wooden pole, with a protective shell 12, embodying the present invention, are shown in FIG. 1 of the drawings. While a piling of the type used along shorelines in the construction of docks, piers and the like is illustrated, the shell 12 is equally applicable to poles of the type anchored in the ground, as in on-shore installations, utility poles, and the like. In both cases, a limited area of the piling or pole intermediate its ends benefits from protection. For example, the shell 12 covers the portion of the piling 10 at the splash line of the high tide level of the body of water in which the piling is located. This is an area where water and oxygen facilitate the existence of organisms, such as borers and the like that are harmful to wood. In contrast, an area that is submerged much or all of the time in the body of water will typically not deteriorate as rapidly as the area at the splash line because of the lack of available oxygen. Poles supported directly in soil also benefit from a shell 12 located partially above and partially below the ground line, where water and moisture are prevalent, for similar reasons.

Figure 7:
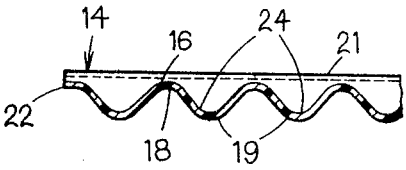
FIG. 7 is a longitudinal sectional view of the strip of FIG. 2 taken along the line 7—7.

The shell 12 is comprised of a flat strip 14 (FIG. 2) of still but not rigid material that can be curved into a tubular shape when applied to the piling 10. Preferably the material of which the strip is formed is resistant to deterioration from water and sunlight, and is tough and abrasion-resistant. The strip has a surface 16 that forms the inside of the shell 12, a surface 18 that forms the outside of the shell 12, straight, parallel, longitudinal side edges 20, 21, and first and second opposite ends 22, 23, parallel to each other and perpendicular to the side edges. Thus, in the preferred embodiment shown, the strip 14 is generally rectangular in shape. A plurality of pockets 24 (FIGS. 2 and 7) are formed in the inside surface 16 between the longitudinal sides 20, 21 at closely spaced locations along the length of the strip. Preferably, the pockets are elongated in the direction across the strip and narrow in width. The pockets are substantially deeper than the thickness of the strip 14 and hence extend from the opposite side 18 to form projections 19, which in the preferred embodiment shown, are in the form of ribs. As shown, the pockets end short of the edges 20, 21 that form the longitudinally spaced circular ends of the tubular shell 12. As shown in FIG. 7, the pockets are recessed slightly relative to the plane of the edges 20, 21 so the surfaces between pockets will be spaced slightly from the pole surface when the strip is in place. In the preferred embodiment, the strip 14 is of a thermoformable plastic material, initially flat, and the pockets 24 are thermoformed using a suitable molding surface.

Figure 2:
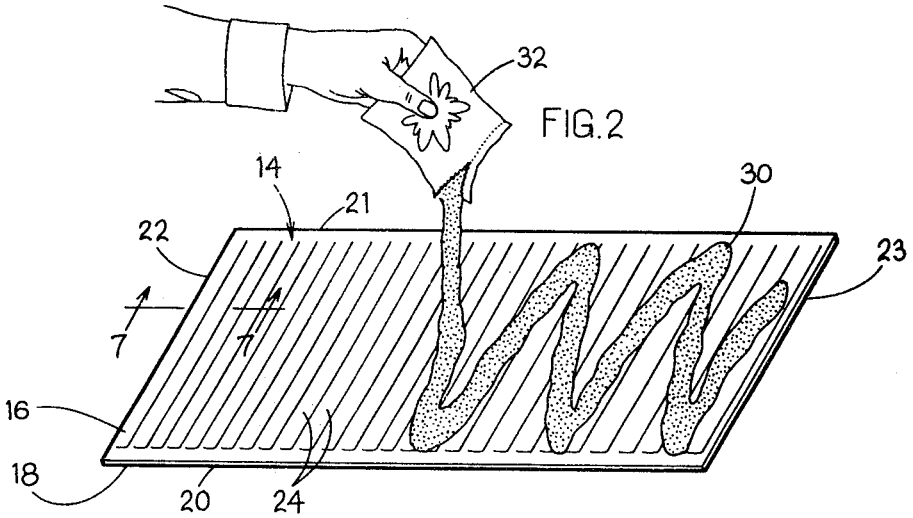
FIG. 2 is a perspective view of a strip that forms the protective shell of FIG. 1, illustrating the manner of applying a foamable adhesive to the strip.
Figure 3:
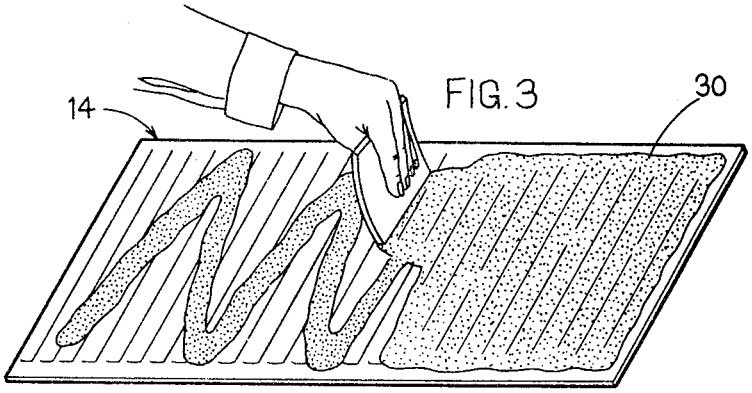
FIG. 3 is a perspective view similar to FIG. 2, illustrating a subsequent step of spreading the foamable adhesive on the strip.
Figure 4:
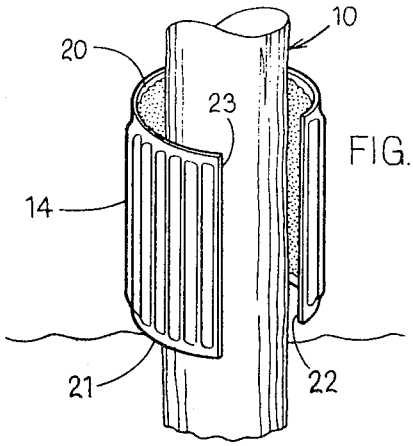
FIG. 4 is a perspective view illustrating the manner in which the strip of FIGS. 2 and 3 is curved into a tubular shape and applied to a piling to form the shell illustrated in FIG. 1.
Figure 5:
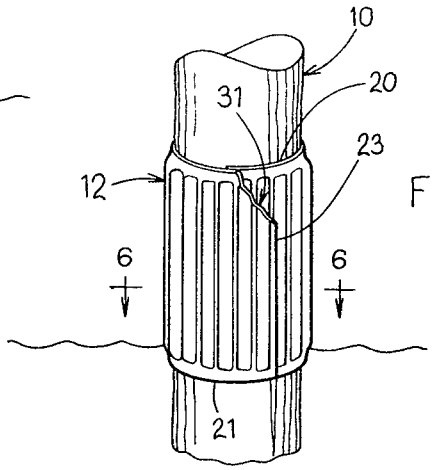
FIG. 5 is a perspective view similar to FIG. 4, illustrating the shell of FIG. 4 tightly wrapped about a piling, and illustrating the manner in which the ends of the strip are overlapped.

A foamed adhesive 30 covers the piling 10 beneath the shell 12. The adhesive forms a layer between the shell and piling that extends into the surface crevices of the piling and seals the piling surface beneath the shell. The foamed adhesive also firmly adheres the shell to the piling and forms a cushion between the shell and piling. The layer of adhesive is foamed in place after the strip 14 is wrapped around the piling to assure entry of the adhesive under pressure into all crevices and to assure a coating and cushion beneath the entire shell. Advantageously, the foamed adhesive is formed from a two-component resin that, when mixed, foams within a short period of time and then cures or hardens. The components can be conveniently provided in a divided plastic bag 32 (FIG. 2) in the proper ratio and amount for a strip 14 of suitable length for a typically sized piling. The components can be mixed within the bag 32 and then dispensed onto the surface 16, as illustrated in FIG. 2, and then spread evenly over the surface as shown in FIG. 3. The mixed material will substantially fill the pockets and coat the surface 16 before substantial foaming occurs. In the initial stages of foaming, the material deliquefies or jells, becoming substantially more viscous, and the sheet 14 can then be held vertically and curved about the piling 10 without loss or deleterious displacement of the adhesive.

Figure 6:
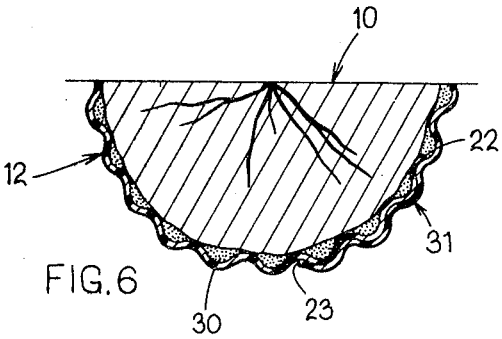
FIG. 6 is a partial transverse sectional view of the piling and shell of FIG. 5, taken along the line 6—6, illustrating the overlapped ends and the foamed coating of adhesive that seals the surface of the strip to the piling.

The length of the strip 14 is selected to be slightly longer than the circumference of the piling 10 to which the strip is to be applied, by at least the width of one pocket 24 and preferably by a length equal to that occupied by two or three pockets. Conveniently, the strip can be cut from a roll to the desired length. The opposite ends 22, 23 of the strip are overlapped when the strip is applied to the piling; i.e., after it tightly encircles the piling, conforming generally to the cross sectional shape. This results in an overlap seam 31 where the projections or ribs 19 on the outside surface 18 of the strip are nested into corresponding pockets 24 of the overlapping end 23. By pressing the overlapped ends to interlock the pockets and ribs, foaming of the adhesive material between the two ends at the overlap seam is inhibited. The end 23 is held pressed against the end 22 for a short period, until the foaming between the piling and strip is completed and the adhesive material begins to set. With a suitable adhesive, this may take on the order of 30 seconds. Unexpanded, the adhesive between the overlapped ends is strongly adherent, resulting in a tight bond between the ends 22, 23 securing the strip in its tubular configuration tightly about the piling. The nested pockets and ribs restrain expansion of the tubular shape circumferentially under the expanding pressure of the adhesive, so the adhesive volume is restrained, forcing the adhesive to flow under pressure into all crevices and to spread thoroughly beneath the entire inside surface 16 of the strip and to fill all of the pockets, thereby providing a complete coating and cushion beneath the shell 12. After the adhesive cures in a relatively short time, the resulting foamed adhesive supports and reinforces the shell and absorbs any impact in use over a broad area. The expanded foam, which fills all of the pockets as well as crevices of the piling, is illustrated in FIG. 6.

Figure 8:
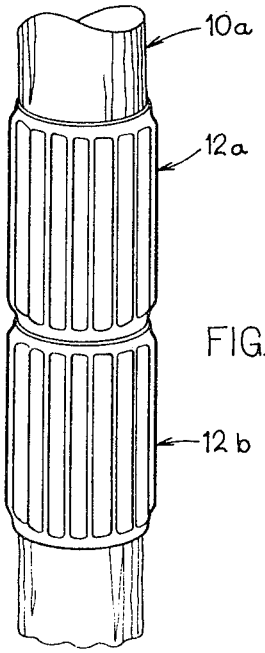
FIG. 8 is a perspective view of a piling or pole showing two protective shells in abutting relationship to cover a larger area.

As shown in FIG. 8, two shells **12*a*, 12*b*, each identical to the shell 12 described above, can be used about a piling 10*a***, where a longitudinal area greater than the width of one shell-forming strip is desired. While the two shells are shown in abutting relationship, the end of one can overlap the adjacent end of the other if desired to assure continuity of protection.

A preferred material from which the strip 14 can be made is acrylonitrile-butadiene-styrene (ABS), such as Cycolac, manufactured by Borg-Warner Corporation, which is thermoformable, strong, and flexible. Advantageously, the material can be coated with a urethane spray or an outer layer of acrylic cladding (such as Korad sold by Korad, Inc., a subsidiary of XCel Corporation) laminated to it that is more resistant to ultraviolet light than is ABS, to inhibit deterioration. A preferred foamed adhesive layer and cushion is polyurethane foam of between 3.0 and 7.5 pounds per cubic foot density (preferably about 4.5 pounds per cubic foot), which is semi-rigid and may be extended with additives for compatibility with creosote or other wood preservatives to enhance its adhesiveness. No special preparation of the piling or pole surface, other than clearing off any foreign material, is required with polyurethane foam. Where desired, a wood preservative can be put in the foam for additional protection of the piling or pole.

While the foam base and the strong shell 12 described provide high strength, additional strength can be obtained by applying two layers of strips 14. Also, in the event of damage, such as a hole or tear in the shell, the damaged portion can be readily repaired by cutting a patch from another strip 14. The patch must be larger than the hole and will include pockets or ribs compatible with those of the original shell. The patch is applied over the existing shell and hole, so that the patch overlaps the edges of the shell about the hole or tear. The pockets of the patch nest with the ribs of the existing shell. Foam is applied to the entire inside surface of the patch and the patch is then placed over the hole and held in place until the foamable adhesive foams and at least partially cures. In the event a nail is driven through the shell, the foamed adhesive acts as a gasket about the nail, due to inherent resiliency of the foam, providing a tight seal that inhibits the entrance of water or moisture. In addition, because the foam is tightly sealed against the surface of the piling or pole, there is no opportunity for water or moisture that enters an opening to spread in contact with the wood, even if it penetrates the shell and the foam.

The pockets 24 and the resulting projections 19 on the outside surface of the shell that are spaced from each other by valleys or depressions, make it convenient to apply a highly visible pattern on the outside surface of the shell by coating only the portions that project the farthest. In the preferred embodiment shown, in which longitudinal ribs 19 are provided, a highly visible striped pattern is thereby created.

In situations where the protective shell is not needed to resist abrasion or impact, the strip 14 can be of polyethylene or other material that will not adhere to the foamed material and be removed after the material has foamed and set. In such an instance, the strip serves as an effective carrier and mold for the foamable material, arriving a uniform distribution of foamed material about the pole, which serves to seal the underlying surface from air, moisture and water. Preferably, the foamable material is a self-skinning urethane. Although the strip 14 initially contacts the pole between the pockets, it expands slightly under the expansion pressure of the foam, allowing the foam to completely cover the pole surface beneath the strip.

While preferred embodiments of the invention have been described in detail, it will be apparent that various modifications and alterations may be made therein without departing from the spirit and scope of the invention set forth in the appended claims.

What is claimed is:

1. A method of protecting a portion of a pole or piling intermediate its ends, comprising the steps of providing a still but not rigid protective shell capable of being formed into a tubular configuration and having pockets in one surface of the shell and corresponding extending projections in the opposite surface, establishing a length of the shell greater by at least the width of one of said pockets than the perimeter of the pole or piling at the location to be protected, coating said one surface with a foamable adherent material in sufficient quantity to fill the pockets and cover said surface when the foamable material expands, applying the shell about the pole or piling before the foamable material has substantially expanded and overlapping the ends so that at least one projection is nested within a pocket at the overlapped ends, and maintaining the shell about the pole or piling while the material expands, hardens, and adheres to the pole or piling.

2. A method as set forth in claim 1 including the subsequent step of removing the shell from around the material adhered to the pole or piling.

* * * * *

UNITED STATES PATENT AND TRADEMARK OFFICE

CERTIFICATE OF CORRECTION

PATENT NO. : 4,244,156

DATED : January 13, 1981

INVENTOR(S) : Ridley Watts, Jr.

It is certified that error appears in the above-identified patent and that said Letters Patent are hereby corrected as shown below:

In the Abstract, line 10, change "forms" to -- foams --.

Column 6, line 27 (Claim 1), change "still" to -- stiff --.

Signed and Sealed this

*Nineteenth* Day of *May 1981*

[SEAL]

*Attest:*

RENE D. TEGTMEYER

*Attesting Officer*

*Acting Commissioner of Patents and Trademarks*